US011224317B1

(12) United States Patent
Rosas, Jr.

(10) Patent No.: US 11,224,317 B1
(45) Date of Patent: Jan. 18, 2022

(54) TOILET SEAT LIFTING HANDLE

(71) Applicant: Hugo Rosas, Jr., Carson, CA (US)

(72) Inventor: Hugo Rosas, Jr., Carson, CA (US)

( * ) Notice: Subject to any disclaimer, the term of this patent is extended or adjusted under 35 U.S.C. 154(b) by 0 days.

(21) Appl. No.: 16/857,991

(22) Filed: Apr. 24, 2020

(51) Int. Cl.
*A47K 13/10* (2006.01)
*E05F 3/20* (2006.01)
*A47K 13/12* (2006.01)

(52) U.S. Cl.
CPC ..... *A47K 13/105* (2013.01); *A47K 13/12* (2013.01); *E05F 3/20* (2013.01); *E05Y 2900/614* (2013.01)

(58) Field of Classification Search
CPC ..... A47K 13/105; A47K 13/12; E03F 3/20; E05Y 2900/614
See application file for complete search history.

(56) References Cited

U.S. PATENT DOCUMENTS 2,011,404 A * 8/1935 Giliasso ..... A47K 13/10 4/246.4
3,717,884 A 2/1973 Mantooth
3,781,924 A 1/1974 Davis, Jr.
4,338,690 A 7/1982 Hsieh et al.
4,426,743 A * 1/1984 Seabrooke ..... A47K 13/10 4/241
5,279,000 A 1/1994 Mercier et al.
5,371,906 A 12/1994 Tzang
6,112,335 A 9/2000 Gaston
7,475,437 B2 * 1/2009 Herrera-Gurrola ..... A47K 13/105 4/246.3
8,555,427 B2 10/2013 Stauber et al.
8,910,320 B2 12/2014 Stauber et al.
2012/0054949 A1 * 3/2012 Barcelo ..... A47K 13/105 4/246.1

OTHER PUBLICATIONS

Minixi Lift Up Automatically(None Electric) Oval Toilet Seat,Auto lifting,White. Product Listing [online]. © 1996-2020, Amazon.com, Inc. [retrieved on Apr. 4, 2019]. Retrieved from the Internet: <URL: https://www.amazon.com/Minixi-Automatically-Electric-Toilet-lifting/dp/B01BFBBVM8?th=1>.

* cited by examiner

*Primary Examiner* — Erin Deery
(74) *Attorney, Agent, or Firm* — Cramer Patent & Design, PLLC; Aaron R. Cramer

(57) ABSTRACT

A toilet seat lifting handle includes a first tubular structure secured about the hinge assembly of a traditionally configured toilet seat. A second tubular structure handle protrudes at a right angle at a first end of the first tubular structure thereby lifting or lowering the toilet seat lid when actuated.

17 Claims, 4 Drawing Sheets

TOILET SEAT LIFTING HANDLE

RELATED APPLICATION

None.

FIELD OF THE INVENTION

The presently disclosed subject matter is directed to a lifting handle and more specifically to a toilet seat lifting handle.

BACKGROUND OF THE INVENTION

Women have been known to complain that their husbands and the other males with which they may live or otherwise encounter, never seem to grasp the importance of lowering the toilet seat after use. Truthfully however, in raising and lowering the toilet seat or toilet lid one exposes themselves to a myriad of germs and bacteria that jeopardize their health and well-being. As a result, many people resort to trying to use their feet or wrap toilet paper around their hands when raising and lowering the seat and lid in order to avoid contact, especially in public restrooms.

Accordingly, there is a need for a means by which the raising and lowering of a toilet seat and lid can be accomplished in a manner such that it does not expose the user to any unsanitary conditions present on the toilet seat or lid. The development of the Toilet Seat Lifting Handle fulfills this need.

SUMMARY OF THE INVENTION

The principles of the present invention provide for a toilet seat lifting device, which comprises a handle assembly which operably controls an upward movement of a toilet seat cover and a toilet seat both of which are engaged simultaneously; a clutching mechanism which is included with the handle assembly that selectively clutches an axle that is in mechanical communication with the toilet seat in an upper rotational movement; a button located on the handle assembly which selectively releases the clutch mechanism, thereby enabling manipulation of the toilet seat and a toilet seat attachment which is included with the toilet seat. The toilet seat attachment is in mechanical communication with the axle and is driven by the same.

The toilet seat lifting device also comprises a handle which has a vertical portion which has a first end and a second end and a handle horizontal portion which has a first end and a second end. The handle horizontal portion is included with the handle assembly and is removably attached to a handle receiver. The toilet seat lifting device also comprises an ergonomic grip which is coupled about an outer diameter of the first end of the handle vertical portion and a chuck which extends away along a centrally located longitudinal axial centerline of the handle horizontal portion. The chuck has a chuck pin.

The toilet seat lifting device also comprises an engagement pin which has a first end which terminates at the first end of the handle receiver. The chuck of the handle horizontal portion has a center bore permitting passage of the first end of the engagement pin therethrough while a second end of the engagement pin is fixedly attached to a first gear that resides within the first end of the axle. The toilet seat lifting device also comprises a second gear which is located within the first end of the axle positioned between the first gear and the terminal portion of the first end of the axle that is affixed to the axle in such a manner as to drive the axle. The toilet seat lifting device also comprises a Bowden cable which resides within the handle assembly. The Bowden cable has a first end that terminates within the handle vertical portion on a moving member and a second end that terminates at the terminal end of the second end of the handle horizontal portion. The toilet seat lifting device also comprises a second spring which resides within the handle vertical portion and is attached to an upper inner surface and to the moving member. Depression of the second spring operably controls the Bowden cable, which linearly displaces the engagement pin to force the first gear away from meshing with the second gear against a first spring to disengage the handle assembly from the toilet seat.

The handle assembly may be manipulated to a forward horizontal position to reengage the clutching mechanism for ease in subsequent use and may have a generally overall cylindrical body. The toilet seat cover may remain in an upward position. The button may extend outside of the top surface of the handle vertical member and may be operably attached to the second spring. A toilet seat cover attachment may rotate independently on the axle such that the toilet seat cover is not directly driven thereby. The handle vertical portion and the handle horizontal portion may be a unitary structure. The handle horizontal portion first end may be an extension of and may angle away ninety-degrees from the second end of the handle vertical portion.

The second end of the handle horizontal portion may be removably attached to the first end of the handle receiver. The handle horizontal portion may be a removable attachment to the handle receiver upon a pulling force. The second end of the handle receiver may be attached to a first end of the axle. The handle horizontal portion may be removed from the handle receiver. The engagement pin may be retained within the handle receiver and first end of the axle and may not be removed. The handle receiver may have a socket which is sized to retain the chuck. The toilet seat lifting device may also comprise a pin receiver which is located within the socket of the handle receiver to receive the chuck pin. The moving member may freely move longitudinally within the handle vertical portion.

The meshing portion of the first gear may selectively engage the meshing portion of the second gear, thus enabling the engagement pin to operably control the first gear, the second gear, the axle, and the toilet seat. The first spring may be located within the first end of the axle that biases the first gear to mesh with the second gear. The second end of the Bowden cable may be engaging and operably controlling the engagement pin when the handle horizontal portion is attached to the handle receiver. The toilet seat lifting device may be installed on at least one mount behind the rim of the toilet bowl of the toilet. The toilet seat lifting device may be an integral part of the toilet that may be a permanent and integral part of the rear of the rim of the toilet bowl.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | toilet seat lifting device |
| 20 | toilet seat cover |
| 21 | toilet seat |
| 22 | toilet seat cover attachment |
| 23 | toilet seat attachment |
| 25 | mount |
| 30 | handle assembly |
| 31 | grip |
| 32a | handle vertical portion |
| 32b | handle horizontal portion |
| 32c | handle receiver |
| 33 | pin receiver |
| 35 | axle |
| 36 | socket |
| 40 | button |
| 41a | first spring |
| 41b | second spring |
| 42 | Bowden cable |
| 43 | moving member |
| 44 | chuck |
| 45 | chuck pin |
| 46 | engagement pin |
| 47a | first gear |
| 47b | second gear |
| 50 | toilet |
| 51 | tank |
| 52 | toilet bowl interior |
| 55 | toilet bowl |
| 56 | rim |
| 100 | user |
| 101 | hand |

DESCRIPTION OF THE PREFERRED EMBODIMENTS

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Figure 1:
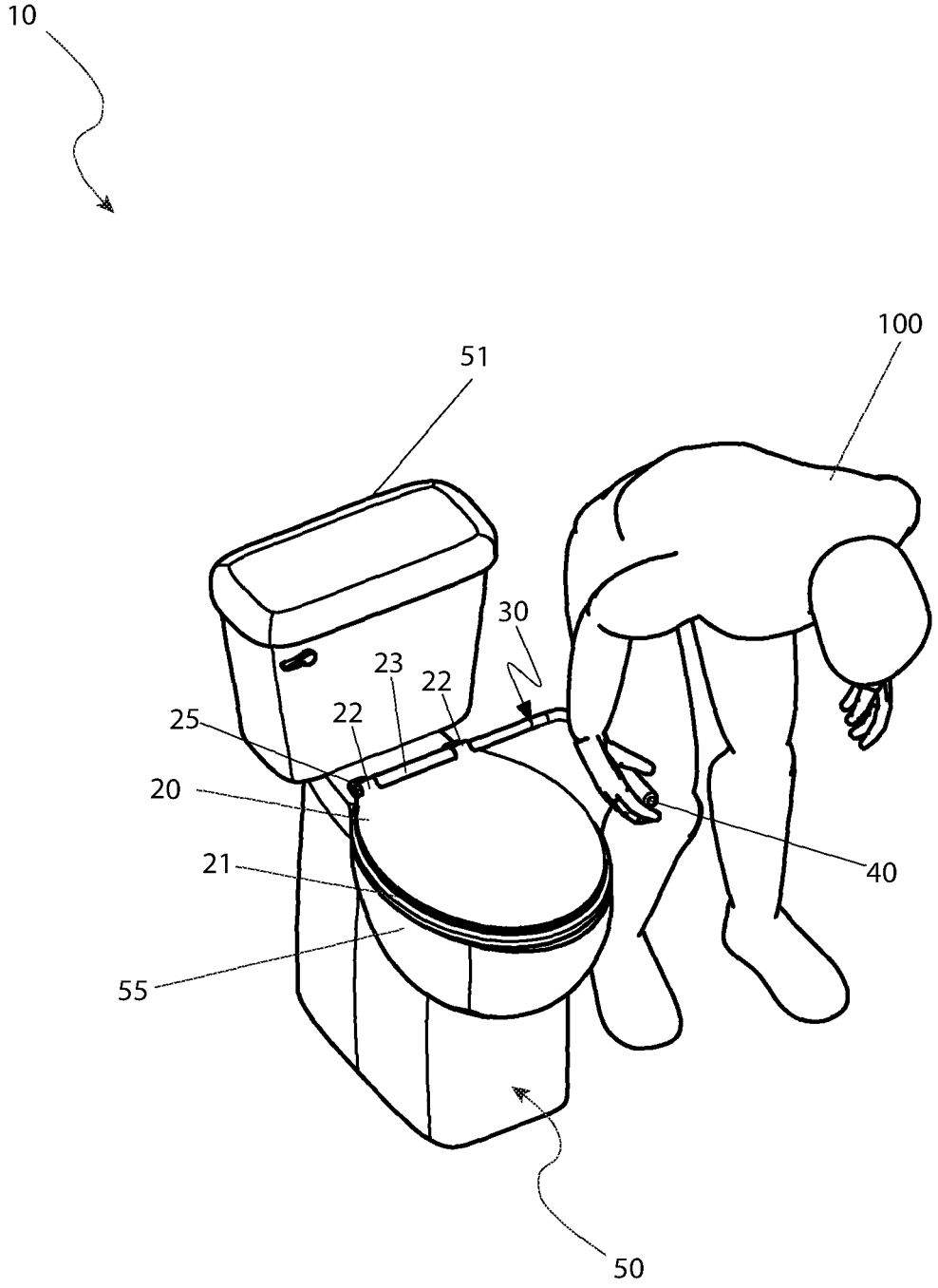
FIG. 1 is an environmental perspective view of the toilet seat lifting device, wherein a toilet seat and toilet seat cover in a down position, according to the preferred embodiment of the present invention.
Figure 2:
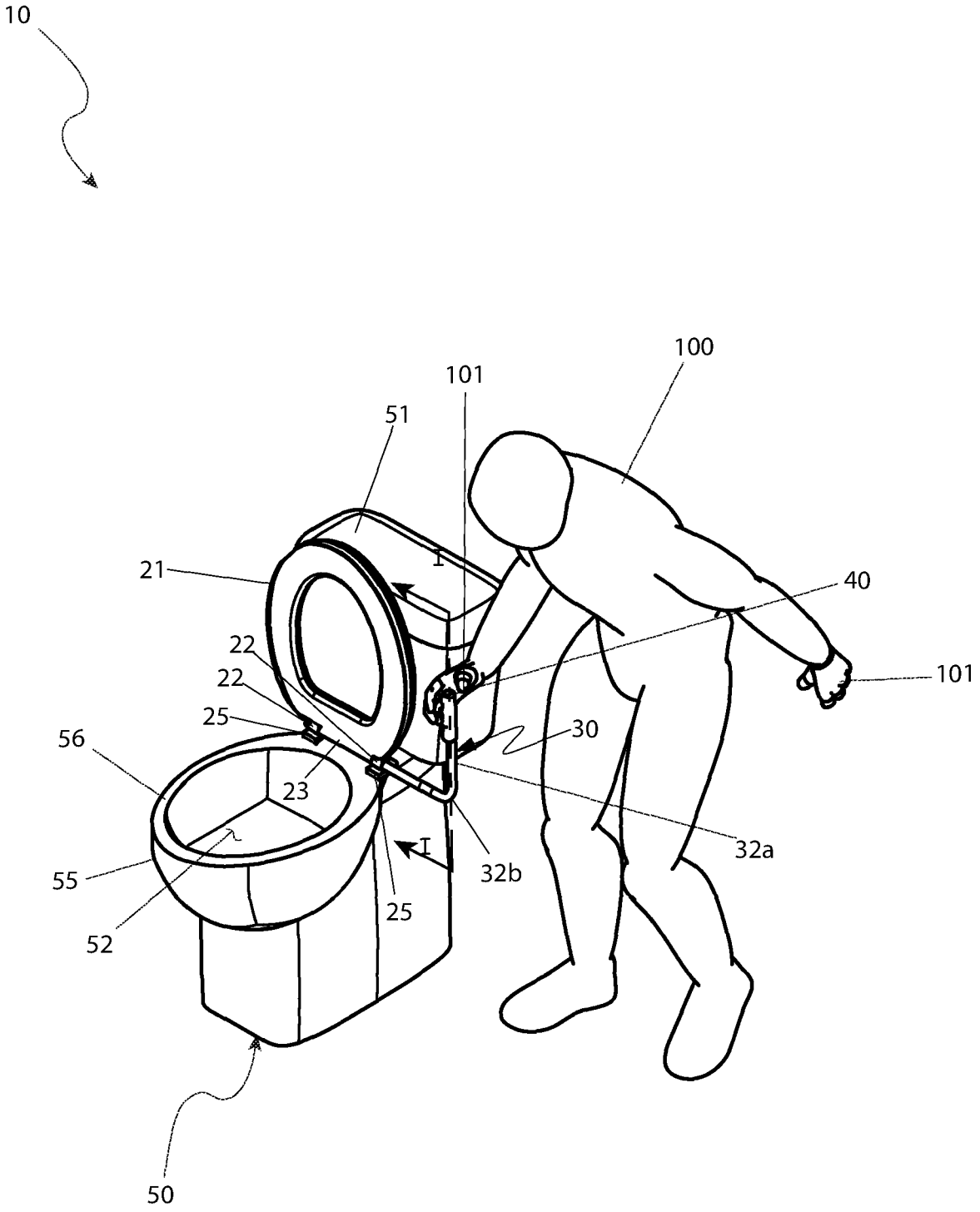
FIG. 2 is an environmental perspective view of the toilet seat lifting device, wherein a toilet seat and toilet seat cover in an up position, according to the preferred embodiment of the present invention.
Figure 3:
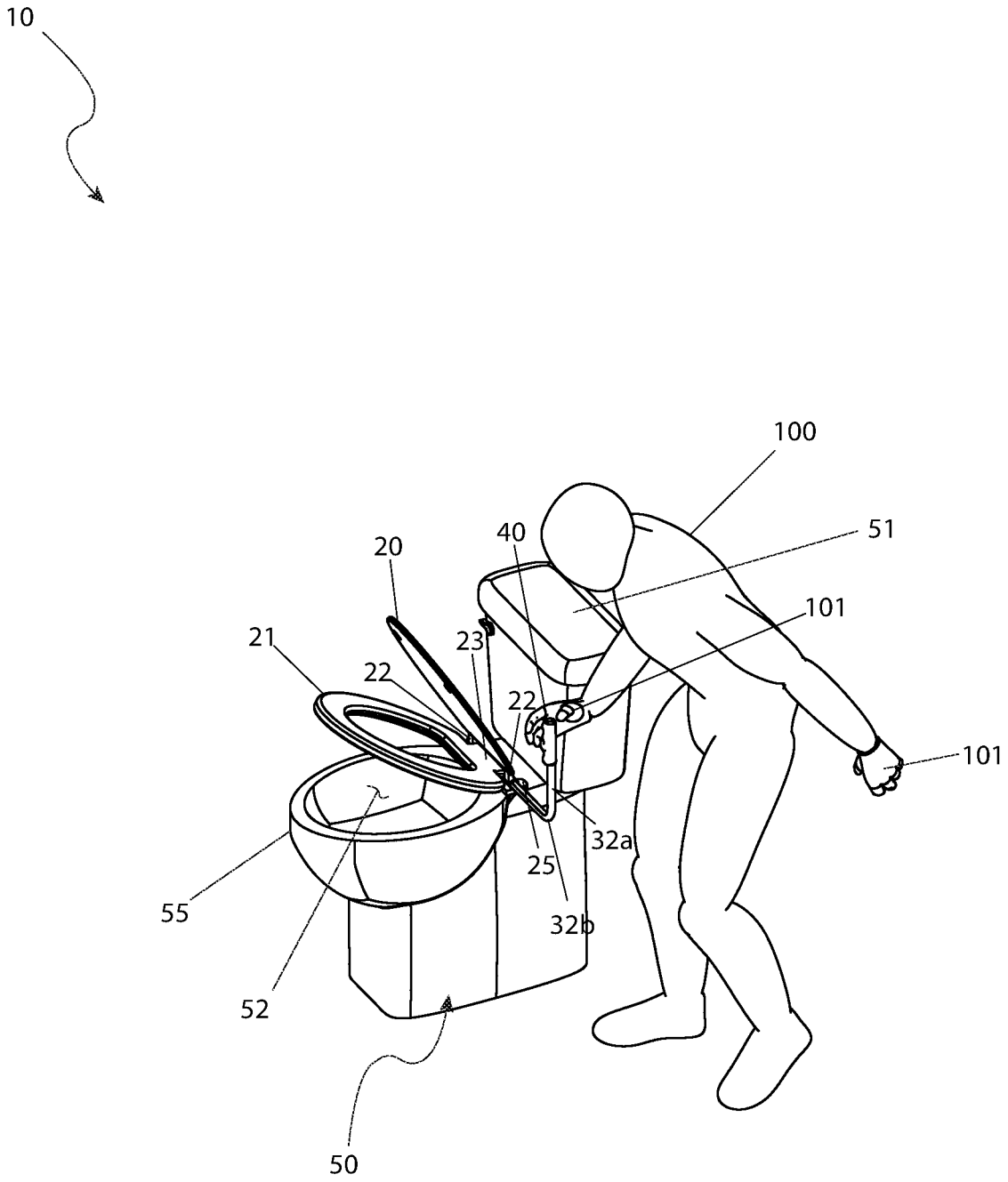
FIG. 3 is an environmental perspective view of the toilet seat lifting device, wherein a toilet seat and toilet seat cover are released from the handle assembly, according to the preferred embodiment of the present invention; and, FIG. 4 is a cut-away view of the handle assembly along the line I-I, according to a preferred embodiment of the present invention.

Referring now to FIGS. 1-3, an environmental perspective view of the toilet seat lifting device (herein described as the "device" 10) is intended to enable a user 100 to grasp with their hand 101 a handle assembly 30 that operably controls upward movement of a toilet seat cover 20 and a toilet seat 21 simultaneously. The handle assembly 30 has a clutching mechanism that selectively clutches an axle 35 that is in mechanical communication with the toilet seat 21 to move it in an upper rotational movement. The toilet seat cover 20, due to its position that abuts the top of the toilet seat 20, moves in conjunction therewith. A button 40 located on the handle assembly 30 selectively releases the clutch mechanism, thereby enabling manipulation of the toilet seat 21 back downward if needed.

FIG. 1 illustrates an initial position of the handle assembly 30 in a forward horizontal position and the toilet seat cover 21 and toilet seat 20 in a closed position (i.e., resting on the rim 56 of the toilet bowl 55 to cover the toilet bowl interior 52. A user 100 is in the process of grasping the handle assembly 30 with a hand 101. FIG. 2 illustrates the handle assembly 30 in an upward vertical position, where the clutching mechanism rotatably motions the toilet seat 21 and toilet seat cover 20 to an upward position off the rim 56 to expose the toilet bowl interior 52. FIG. 3 illustrates the user 100 depressing the button 40 (usually with the same hand 101 as that grasping the handle assembly 30) to release the clutching mechanism to enable manipulation of the toilet seat 21 in a downward position to rest on the rim 56 as desired by the user 100. The toilet seat cover 20 may remain in the upward position if so desired. Release of the button 40 reengages the clutching mechanism. It is preferable that the user 100 manipulates the handle assembly 30 to a forward horizontal position to reengage the clutching mechanism for ease in subsequent use.

Referring now more closely to the device 10 and its installation on a toilet 50, the device 10 is capable of being provided with the toilet seat cover 20 and toilet seat 21 as a combined unit, capable of being installed on at least one (1) mount 25 to a rear of a rim 56 of the toilet bowl 55 of the toilet 50 in an expected manner. In an exemplary embodiment, there are two (2) mounts. The device 10, toilet seat cover 20, and toilet seat 21 may be of the same or similar material of construction, décor, and resiliency. Other embodiments may provide for the device 10 to be an integral part of the toilet 50, where the mounts 25 are a permanent and integral part of the rear of the rim 56 of the toilet bowl 55.

The handle assembly 30 is in selective mechanical communication with the clutching mechanism (housed within the handle assembly 30) which in turn drives an axle 35. The axle 35 is a solid or hollow cylindrical member that passes through each mount 25 in the exemplary embodiment. The toilet seat 20 has a toilet seat attachment 23 that is in mechanical communication with the axle 35 and is driven thereby. In some embodiments, the toilet seat attachment 23 is affixed to the axle 35; in other embodiments, the toilet seat attachment 23 is an integral part of the axle 35. The toilet seat cover 21 resides above the toilet seat 20 and rests thereon when both are disposed down on the rim 56 of the toilet bowl 55. The toilet seat cover 21 has a pair of toilet seat cover attachments 22 that extend away from the bottom of the toilet seat cover 21 and are attached to the axle 35 on either side of the toilet seat attachment 23. The toilet seat cover attachments 22 rotate independently on the axle 35 such that the toilet seat cover 20 is not directly driven thereby.

Figure 4:
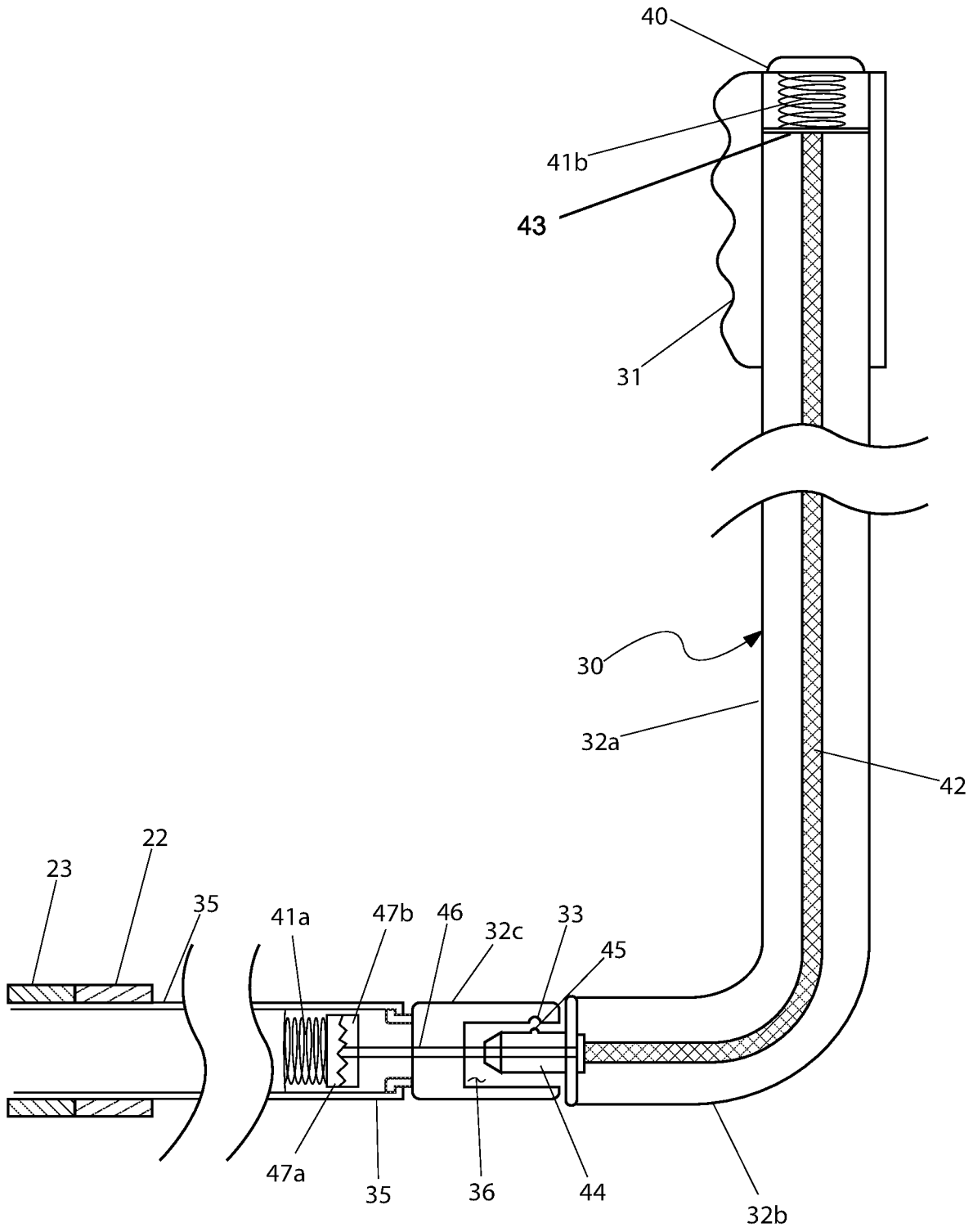

Referring now more closely to FIG. 4, the handle assembly 30 has a generally overall cylindrical body. The handle assembly 30 includes a handle vertical portion 32*a* and a handle horizontal portion 32*b* as a unitary structure, capable of removable attachment to a handle receiver 32*c*. The handle vertical portion 32*a* has a first end and a second end. The handle horizontal portion 32*a* has a first end that is an extension of and angles away much like a ninety-degree (90°) elbow from the second end of the handle vertical portion 32*a*. An ergonomic grip 31 is affixed to or removably attached about the outer diameter of the first end of the handle vertical portion 32*a*. The second end of the handle horizontal portion 32*b* is removably attached to a first end of the handle receiver 32*c*. A chuck 44 extends away along a centrally located longitudinal axial centerline of the handle horizontal portion 32*b*. The chuck 44 has a chuck pin 45. The handle receiver 32*c* has a socket 36 sized to retain the chuck 44 therein. A pin receiver 33 is located within the socket 36 of the handle receiver 32*c* to receive the chuck pin 45. The handle second portion 32*b* is thus capable of removable attachment to the handle receiver 32*c* upon a pulling force. The second end of the handle receiver 32 *c* is attached to a first end of the axle 35. It is envisioned in a preferred embodiment that the outer diameters of the handle vertical portion 32*a*, handle horizontal portion 32*b*, handle receiver 32*c*, and axle 35 are coterminous such that a smooth, almost continuous look of the handle assembly 30 is appreciated.

The clutching mechanism of the device 10 comprises multiple parts to enable selective attachment and detachment of the handle assembly 30 to manipulate the toilet seat 21. The axle 35 has a first end that is selectively and operably controlled by the remainder of the handle assembly 30. An engagement pin 46 has a first end terminating at the first end of the handle receiver 32*c*. The chuck 44 of the handle horizontal portion 32*b* thus has a center bore permitting passage of the first end of the engagement pin 46 therethrough. The second end of the engagement pin 46 is fixedly attached to a first gear 47*a* that resides within the first end of the axle 35. Thus, the engagement pin 46 traverses about a common longitudinal axial centerline of the first end of the axle 35 and the entirety of the handle receiver 32*c*. When the handle horizontal portion 32*b* is removed from the handle receiver 32*c*, the engagement pin 46 is retained within the handle receiver 32*c* and first end of the axle 35 and cannot be removed. The first gear 47*a* is oriented such that the meshing portion thereof is facing the handle receiver 32*c*. A second gear 47*b* is located within the first end of the axle 35, positioned between the first gear 47*a* and the terminal portion of the first end of the axle 35, and is affixed to the axle 35 in such a manner as to drive the axle 35. The meshing portion of the first gear 47*a* selectively engages the meshing portion of the second gear 47*b*, thus enabling the engagement pin 46 to operably control the first gear 47*a*, second gear 47*b*, axle 35, and toilet seat 21. A first spring 41 *a* located within the first end of the axle 35 biases the first gear 47*a* to mesh with the second gear 47*b*.

A Bowden cable 42 resides within the handle assembly 30, having a first end that terminates within the handle vertical portion 32*a* on a moving member 43 and a second end that terminates at the terminal end of the second end of the handle horizontal portion 32*b*. The second end of the Bowden cable 42 is capable of engaging and operably controlling the engagement pin 46 when the handle horizontal portion 32*b* is attached to the handle receiver 32*c*. The moving member 43 freely moves longitudinally within the handle vertical portion 32*a*. A second spring 41*b* resides within the handle vertical portion 32*a* and is attached to an upper inner surface thereof, and to the moving member 43. A button 40 extends outside of the top surface of the handle vertical member 32*a* (or the grip 31) and is operably attached to the second spring 41*b*. Depression of the second spring 41*b* operably controls the Bowden cable 42, which linearly displaces the engagement pin 46 to force the first gear 47*a* away from meshing with the second gear 47*b*, against the first spring 41*a*, to disengage the handle assembly 30 from operably controlling the toilet seat 21.

2. OPERATION OF THE PREFERRED EMBODIMENT

The preferred embodiment of the present invention can be utilized by the common user in a simple and effortless manner with little or no training. It is envisioned that the device 10 would be constructed in general accordance with FIG. 1 through FIG. 3. The user would procure the device 10 from conventional procurement channels such as plumbing supply stores, home improvement stores, mail order and internet supply houses and the like. Special attention would be paid to standard or optional equipment on a new toilet 50 or retrofit operations on an existing toilet 50.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A toilet seat lifting device, comprising:

a handle assembly, the handle assembly operably controlling upward movement of a toilet seat cover and a toilet seat of a toilet such that the toilet seat cover and toilet seat are engaged simultaneously;

a clutching mechanism included with the handle assembly selectively clutching an axle in mechanical communication with the toilet seat in an upper rotational movement;

a button located on the handle assembly selectively releasing the clutching mechanism, thereby enabling manipulation of the toilet seat;

a toilet seat attachment included with the toilet seat, the toilet seat attachment in mechanical communication with the axle and driven thereby;

the handle assembly including:

a handle vertical portion having a first end and a second end;

a handle horizontal portion having a first end and a second end, the handle horizontal portion removably attached to a handle receiver;

an ergonomic grip coupled about an outer diameter of the first end of the handle vertical portion;

and a chuck extending away along a centrally located longitudinal axial centerline of the handle horizontal portion, the chuck having a chuck pin;

an engagement pin having a first end terminating at a first end of the handle receiver, the chuck having a center bore permitting passage of the first end of the engagement pin therethrough, a second end of the engagement pin fixedly attached to a first gear that resides within a first end of the axle;

a second gear located within the first end of the axle and positioned between the first gear and the terminal portion of the first end of the axle, the second gear affixed to the axle in such a manner as to drive the axle;

a Bowden cable residing within the handle assembly, the Bowden cable having a first end terminating within the handle vertical portion on a moving member and a second end terminating at the terminal end of the second end of the handle horizontal portion;

and a second spring residing within the handle vertical portion, the second spring attached to an upper inner surface thereof and to the moving member;

wherein depression of the second spring operably controls the Bowden cable, the Bowden cable linearly displacing the engagement pin and causing the engagement pin to act against the first spring to force the first gear away from meshing with the second gear, thereby disengaging the handle from the axle and allowing the toilet seat to be lowered;

and wherein the clutching mechanism includes the engagement pin, the second spring, the first gear, and the second gear.

2. The toilet seat lifting device, according to claim 1, wherein the handle assembly is manipulated to a forward horizontal position to reengage the clutching mechanism to facilitate subsequent use.

3. The toilet seat lifting device, according to claim 1, wherein each of the handle horizontal portion and the handle vertical portion have a cylindrical body.

4. The toilet seat lifting device, according to claim 1, wherein the button extends outside of a top surface of the handle vertical member and is operably attached to the second spring.

5. The toilet seat lifting device, according to claim 1, wherein a toilet seat cover attachment rotates independently on the axle such that the toilet seat cover is not directly driven thereby.

6. The toilet seat lifting device, according to claim 1, wherein the handle vertical portion and the handle horizontal portion are a unitary structure.

7. The toilet seat lifting device, according to claim 1, wherein the second end of the handle horizontal portion is removably attached to the first end of the handle receiver.

8. The toilet seat lifting device, according to claim 1, wherein the handle horizontal portion is a removable attachment to the handle receiver upon a pulling force.

9. The toilet seat lifting device, according to claim 1, wherein a second end of the handle receiver is attached to the first end of the axle.

10. The toilet seat lifting device, according to claim 1, wherein the handle horizontal portion is removed from the handle receiver, the engagement pin is retained within the handle receiver and the first end of the axle and cannot be removed.

11. The toilet seat lifting device, according to claim 1, wherein the handle receiver has a socket sized to retain the chuck therein.

12. The toilet seat lifting device, according to claim 11, further comprising a pin receiver located within the socket of the handle receiver to receive the chuck pin.

13. The toilet seat lifting device, according to claim 1, wherein the moving member freely moves longitudinally within the handle vertical portion.

14. The toilet seat lifting device, according to claim 1, wherein when the first gear and the second gear are selectively meshed, the engagement pin operably engages the first gear, the second gear, the axle, and the toilet seat.

15. The toilet seat lifting device, according to claim 1, wherein the second end of the Bowden cable is engaging and operably controlling the engagement pin when the handle horizontal portion is attached to the handle receiver.

16. The toilet seat lifting device, according to claim 1, wherein the toilet seat lifting device is installed on at least one mount behind a rim of a toilet bowl of the toilet.

17. The toilet seat lifting device, according to claim 16, wherein the toilet seat lifting device is an integral part of the toilet that is a permanent and integral part of a rear of the rim of the toilet bowl.

* * * * *